US008419370B2

(12) United States Patent
Ruba et al.

(10) Patent No.: US 8,419,370 B2
(45) Date of Patent: Apr. 16, 2013

(54) RETAINING AND SEALING RING ASSEMBLY

(75) Inventors: Daniel Ruba, Zionsville, IN (US); Matthew Scott, Carmel, IN (US); Thomas Bowman, Greenfield, IN (US)

(73) Assignee: Rolls-Royce Corporation, Indianapolis, IN (US)

( * ) Notice: Subject to any disclaimer, the term of this patent is extended or adjusted under 35 U.S.C. 154(b) by 666 days.

(21) Appl. No.: 12/491,276

(22) Filed: Jun. 25, 2009

(65) Prior Publication Data

US 2010/0329873 A1 Dec. 30, 2010

(51) Int. Cl.
*F03B 3/12* (2006.01)

(52) U.S. Cl.
USPC ..... 416/220 R

(58) Field of Classification Search ..... 416/219 R, 416/220 R, 221, 204 A, 244 A, 248, 220 A, 416/219 A
See application file for complete search history.

(56) References Cited

U.S. PATENT DOCUMENTS

| | | | | |
|---|---|---|---|---|
| 1,639,247 | A | | 8/1927 | Zoelly et al. |
| 1,970,435 | A | | 8/1934 | Sharp |
| 2,292,072 | A | | 8/1942 | Hanna et al. |
| 2,823,895 | A | | 2/1958 | Floroff |
| 2,916,258 | A | | 12/1959 | Klint |
| 2,934,259 | A | | 4/1960 | Hausmann |
| 2,948,506 | A | | 8/1960 | Glasser et al. |
| 3,347,520 | A | | 10/1967 | Owczarek |
| 3,644,058 | A | | 2/1972 | Barnabei et al. |
| 3,709,631 | A | | 1/1973 | Karstensen et al. |
| 3,751,183 | A | | 8/1973 | Nichols et al. |
| 4,019,833 | A | | 4/1977 | Gale |
| 4,097,192 | A | | 6/1978 | Kulina |
| 4,182,598 | A | | 1/1980 | Nelson |
| 4,279,572 | A | | 7/1981 | Auriemma |
| 4,349,318 | A | | 9/1982 | Libertini et al. |
| 4,405,285 | A | | 9/1983 | Surdi |
| 4,480,958 | A | * | 11/1984 | Schlechtweg ..... 416/220 R |
| 4,494,909 | A | | 1/1985 | Forestier |
| 4,604,033 | A | * | 8/1986 | Surdi ..... 416/220 R |
| 4,872,812 | A | | 10/1989 | Hendley et al. |
| 4,936,749 | A | | 6/1990 | Arrao et al. |
| 4,967,550 | A | | 11/1990 | Acton et al. |
| 5,005,353 | A | | 4/1991 | Acton et al. |
| 5,230,603 | A | | 7/1993 | Day |
| 5,286,168 | A | | 2/1994 | Smith |
| 5,302,085 | A | | 4/1994 | Dietz et al. |
| 5,313,786 | A | | 5/1994 | Chlus et al. |
| 5,350,279 | A | | 9/1994 | Prentice et al. |
| 5,478,207 | A | | 12/1995 | Stec |
| 5,501,575 | A | | 3/1996 | Eldredge et al. |
| 5,540,551 | A | | 7/1996 | Heinig |
| 5,567,114 | A | | 10/1996 | Wallace |
| 5,573,375 | A | | 11/1996 | Barcza |
| 5,620,303 | A | | 4/1997 | Moffitt et al. |
| 5,667,361 | A | | 9/1997 | Yaeger et al. |

(Continued)

*Primary Examiner* — Nathaniel Wiehe
*Assistant Examiner* — Adam W Brown
(74) *Attorney, Agent, or Firm* — Krieg DeVault LLP

(57) ABSTRACT

A fan blade retaining and sealing ring assembly for an aft side of a bladed disk assembly is disclosed herein. The ring assembly includes an inner ring operable to prevent aft movement of a fan blade positioned in a slot formed in the blade disk. The ring assembly also includes an outer ring operable to seal against a platform of the fan blade. The inner ring and the outer ring are formed from different materials.

31 Claims, 2 Drawing Sheets

U.S. PATENT DOCUMENTS 5,820,346 A * 10/1998 Young et al. ..... 416/193 A
5,913,660 A 6/1999 Knott
5,988,982 A 11/1999 Clauer
5,993,161 A 11/1999 Shapiro
6,042,338 A 3/2000 Brafford et al.
6,195,982 B1 3/2001 Gysling et al.
6,379,112 B1 4/2002 Montgomery
6,428,278 B1 8/2002 Montgomery et al.
6,457,942 B1 10/2002 Forrester
6,471,482 B2 10/2002 Montgomery et al.
6,524,074 B2 2/2003 Farrar et al.
6,582,183 B2 6/2003 Eveker et al.
6,659,725 B2 12/2003 Yeo et al.
6,814,543 B2 11/2004 Barb et al.
7,082,371 B2 7/2006 Griffin et al.
7,147,437 B2 12/2006 Burdgick et al.
RE39,630 E 5/2007 Stangeland et al.
7,252,481 B2 8/2007 Stone
7,258,529 B2 8/2007 Wagner
7,264,447 B2 9/2007 Ono et al.
7,500,299 B2 3/2009 Dupeux et al.
7,500,832 B2 3/2009 Zagar et al.
7,520,718 B2 4/2009 Engle
7,530,791 B2 5/2009 Douville et al.

* cited by examiner

RETAINING AND SEALING RING ASSEMBLY

BACKGROUND OF THE INVENTION

1. Field of the Invention

The invention relates to an assembly for preventing aft movement of a blade disposed in a slot and for sealing against a platform of the blade.

2. Description of Related Prior Art

U.S. Pat. No. 5,501,575 discloses a fan blade attachment for gas turbine engines. A sloped deep slot is formed in the rim of a disk for accepting the dovetail of a root of the fan or compressor blade allowing the removal of a single blade from the disk. A segmented retainer plate is disposed at the aft end of the blade root and bears against the blade root to react out the slope induced axial blade loads, providing a low hub-tip ratio configuration. An annular shaped seal plate is adjacent to a platform of the blade and is utilized so as to prevent recirculation of the air in the attachment at the rim of the rotor disk.

SUMMARY OF THE INVENTION

In summary, the invention is a fan blade retaining and sealing ring assembly for an aft side of a bladed disk assembly. The ring assembly includes an inner ring operable to prevent aft movement of a fan blade positioned in a slot formed in a blade disk. The ring assembly also includes an outer ring operable to seal against a platform of the fan blade. The inner ring and the outer ring are formed from different materials.

BRIEF DESCRIPTION OF THE DRAWINGS

Advantages of the present invention will be readily appreciated as the same becomes better understood by reference to the following detailed description when considered in connection with the accompanying drawings wherein.

DETAILED DESCRIPTION OF AN EXEMPLARY EMBODIMENT

The invention, as exemplified in the embodiment described below, can be applied to substantially reduce the cost of retaining fan blades and sealing the bladed disk assembly. In the exemplary embodiment, the application of the invention can reduce the cost of the retaining and sealing structures by 40%. The basis of the cost savings will be described below.

Figure 1:
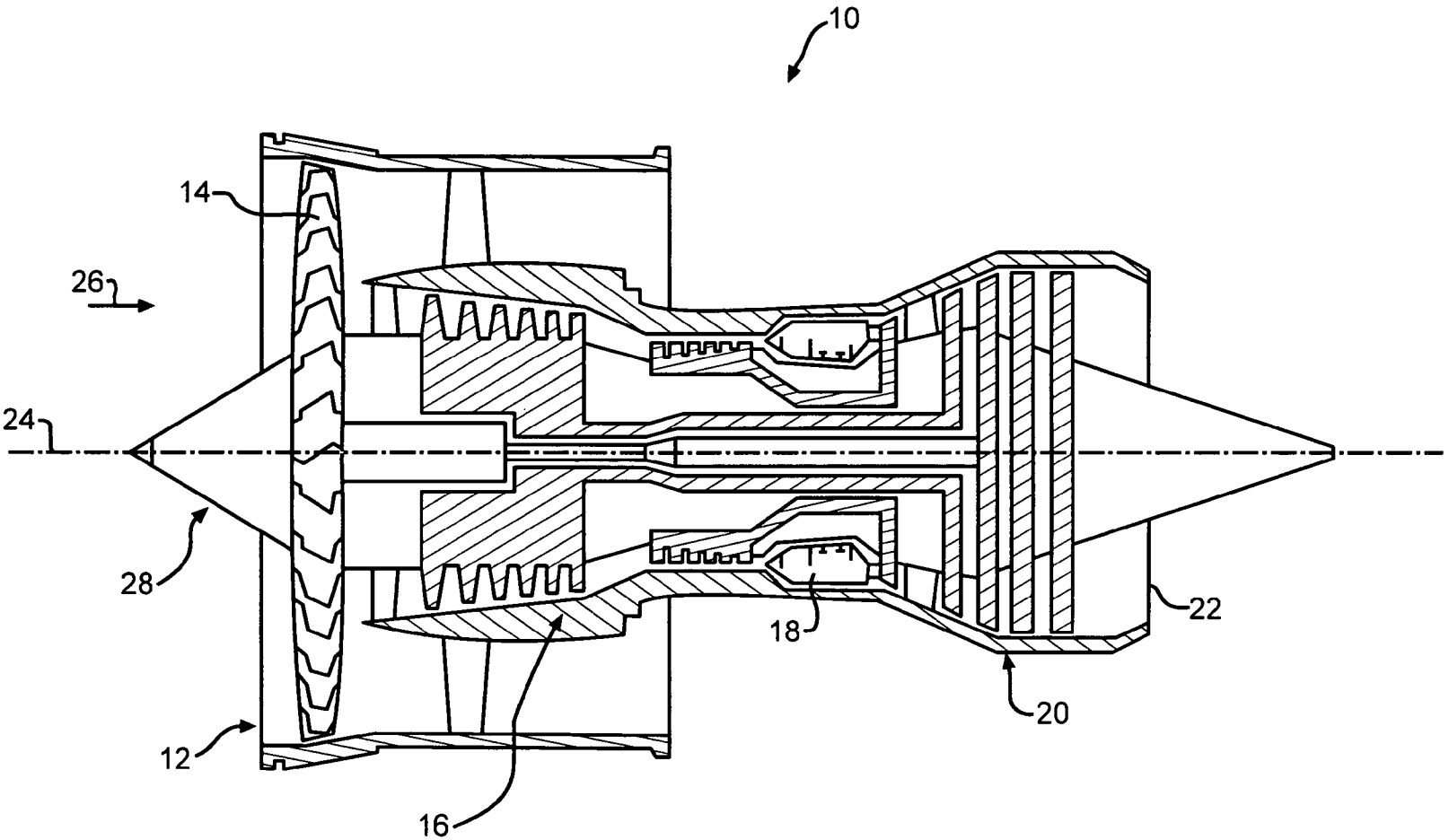
FIG. 1 is a simplified cross-section of a turbine engine according to an embodiment of the invention.

Referring to FIG. 1, a turbine engine 10 can include an inlet 12 and a fan 14. The exemplary fan 14 can be a bladed disk assembly having a disk or hub defining a plurality of slots and a plurality of fan blades, each fan blade received in one of the slots. The turbine engine can also include a compressor section 16, a combustor section 18, and a turbine section 20. The turbine engine 10 can also include an exhaust section 22. The fan 14, compressor section 16, and turbine section 20 are all arranged to rotate about a centerline axis 24. Fluid such as air can be drawn into the turbine engine 10 as indicated by the arrow referenced at 26. The fan 14 directs fluid to the compressor section 16 where it is compressed. The compressed fluid is mixed with fuel and ignited in the combustor section 18. Combustion gases exit the combustor section 18 and flow through the turbine section 20. Energy is extracted from the combustion gases in the turbine section 20.

Figure 2:
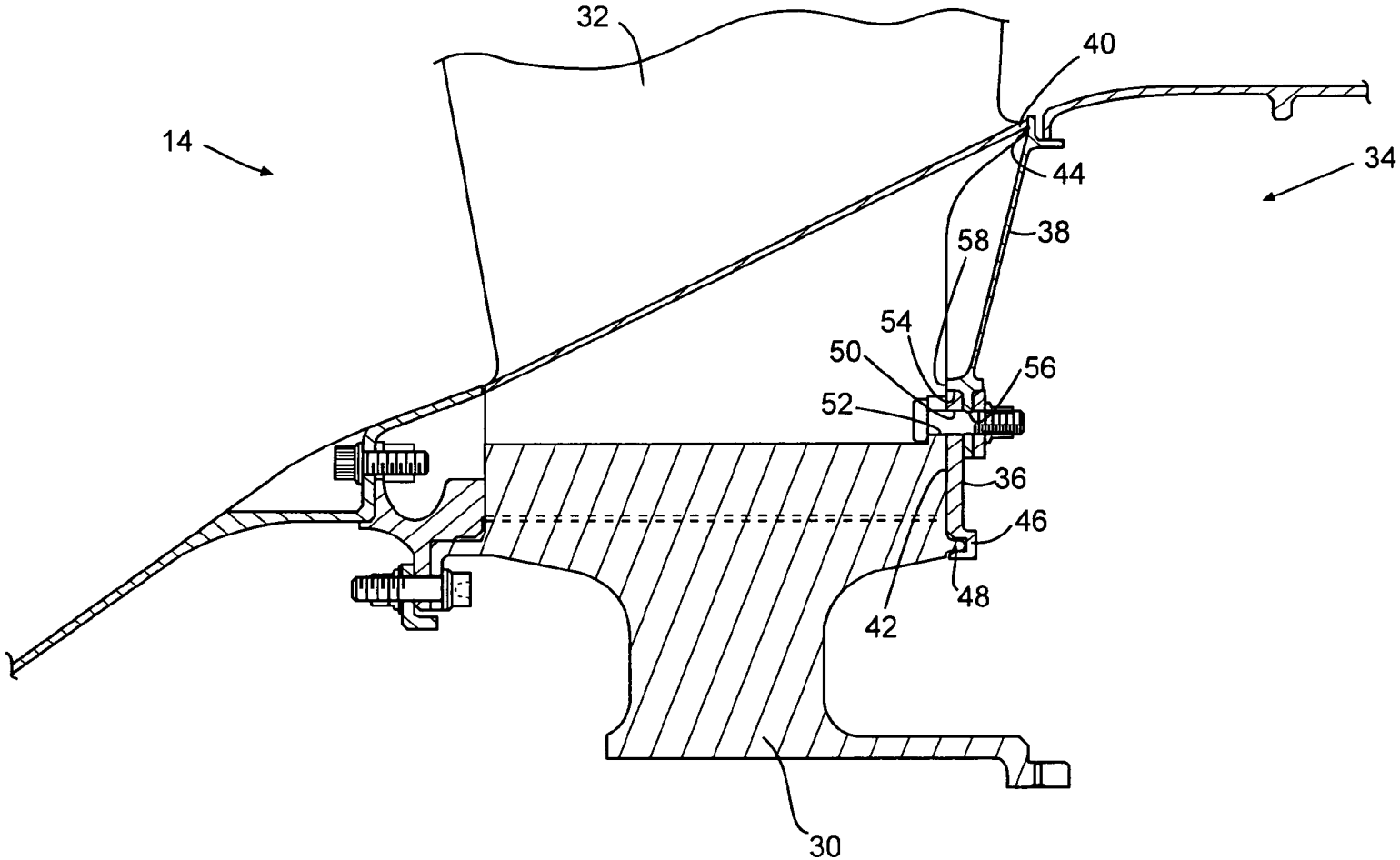
FIG. 2 is an enlarged portion of FIG. 1.

A nose cone assembly 28 can be attached to the fan 14. As set forth above and shown in FIG. 2, the exemplary fan 14 can be a bladed disk assembly having a disk or hub 30 defining a plurality of slots. The bladed disk assembly 14 can also include a plurality of fan blades 32. Each fan blade 32 can be received in one of the slots.

A fan blade retaining and sealing ring assembly 34 can be disposed adjacent to an aft side of the bladed disk assembly 14. The ring assembly 34 includes an inner ring 36 operable to prevent aft movement of the fan blade 32. The ring assembly 34 also includes an outer ring 38 operable to seal against a platform 40 of the fan blade 32. The inner ring 36 and the outer ring 38 are formed from different materials. The respective cross-sections of the inner and outer rings 36, 38 shown in FIG. 2 can be the respective cross-sections of the inner and outer rings 36, 38 at any point about the axis 24 (shown in FIG. 1).

The inner ring 36 can be formed from a first material defining a first strength and the outer ring 38 can be formed from a second material defining a second strength less than the first strength. For example, the inner ring 36 can be formed from titanium and the outer ring 38 can be formed from aluminum. The inner ring 36 can be subjected to higher loading than the outer ring 38 and can therefore be formed from a stronger material. Thus, in the exemplary embodiment, the amount of relatively stronger material that is used can be minimized. Relatively stronger material can be used only for the portion of the ring assembly 34 applied to retain the fan blade 32 and not the portion used to seal. Generally, stronger material can be more expensive and/or heavier.

The outer ring 38 can be formed from a material that is more machinable than the material from which the inner ring 36 is formed. The term machinability refers to the ease with which a material can be removed. Cutting and grinding are two processes by which material is removed from a workpiece. Materials with relatively greater or higher machinability require relatively lower power for material removal. Also, materials with relatively greater or higher machinability impart relatively lower wear on the tooling. In most cases, the strength and toughness of a material are the primary factors relating to machinability. However, other factors affect machinability, including the composition of the material, the thermal conductivity, the cutting tool geometry, and the machining process parameters.

As set forth above, forming the ring assembly 34 with different materials can reduce cost by minimizing the amount of stronger material that is used in forming the ring assembly 34. Bifurcating the structures of the ring assembly 34 applied for retaining and for sealing can also reduce cost by simplifying the design of the less-machinable structure. For example, a sealing surface is generally more costly to produce that a general load-bearing surface. Generally, the sealing surface must usually define a particular surface finish which can increase cost. Also, the geometric position of a sealing surface is usually subject to a tighter tolerance and tighter tolerances generally increase cost. In the exemplary embodiment, the inner ring 36 can define a load bearing surface 42 and the outer ring 38 can define a sealing surface 44. Thus, the less machinable portion of the ring assembly (the inner ring 36) can be a relatively simple ring shape. The sealing surface 44 can be defined by the more machinable outer ring 38. Also, the usage of separate sealing and retention components can result in lower input material volume compared to a single-component (with single forging or plate) design. Therefore, the volume of material to be removed via machining operations is significantly reduced.

The outer ring 38 can contact the blade disk 30 at a radially inner and axially-facing surface 58. The outer ring 38 can contact the platform 40 at the sealing surface 44. The sealing surface 44 is radially-spaced from the surface 58. The outer ring 38 can be axially spaced from the blade disk 30 along at least part of the radial distance between the surface 58 and the sealing surface 44.

The inner ring 36 and the outer ring 38 can be centered on a common axis and abut one another along the axis. In the exemplary embodiment, the common axis can be the centerline axis 24 (shown in FIG. 1). The exemplary inner ring 36 can include an annular hook 46. The blade disk 30 can include an annular projection 48 received in the annular hook 46. Cooperation between the annular hook 46 and the annular projection 48 can locate the inner ring 36 radially relative to the blade disk 30.

The inner ring 36 can also include apertures 50. The blade disk 30 can include corresponding apertures 52. The apertures 50 and 52 can be aligned to locate the inner ring 36 circumferentially relative to the blade disk 30. Thus, the inner ring 36 can be located relative to the blade disk 30 with at least two structures defined by the inner ring 36.

The exemplary outer ring 38 can include an annular slot 54 in which the inner ring 36 can be received. The inner ring 36 and the outer ring 38 can thus overlap one another axially and radially relative to the centerline axis 24 (shown in FIG. 1) of the blade disk 30. The outer ring 38 can also include apertures 56. The apertures 50, 52 and 56 can be aligned with one another and receive fasteners for joining the inner ring 36 and the outer ring 38 to the blade disk 30. The outer ring 38 can therefore be located relative to the blade disk 30 through the inner ring 36 and with a plurality of structures (the apertures 56) defined by the outer ring 38.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. The right to claim elements and/or sub-combinations of the combinations disclosed herein is hereby reserved.

What is claimed is:

1. A fan blade retaining and sealing ring assembly for an aft side of a bladed disk assembly comprising:

an inner ring operable to prevent aft movement of a fan blade, said fan blade including a portion positioned in a slot formed in the blade disk, said inner ring including a load bearing surface engaged in abutment against an aft-most end surface of said portion of said fan blade positioned in said slot in said blade disk to prevent said aft movement; and an outer ring operable to seal against a platform of the fan blade, wherein said inner ring and said outer ring are formed from different materials.

2. The ring assembly of claim 1 wherein said inner ring is formed from a first material defining a first strength and said outer ring is formed from a second material defining a second strength less than the first strength.

3. The ring assembly of claim 1 wherein said inner ring and said outer ring are centered on a common axis and abut one another along said axis.

4. The ring assembly of claim 3 wherein said inner ring and said outer ring radially overlap one another relative to said axis.

5. The ring assembly of claim 1 wherein said inner ring is formed from titanium and said outer ring is formed from aluminum.

6. The ring assembly of claim 1 wherein said inner ring and said outer ring are concentric and wherein said outer ring further comprises an annular slot in which said inner ring is received, and wherein said outer ring includes a radial inner surface adjacent said annular slot, said radial inner surface engaged in abutment against said aft-most end surface of said portion of said fan blade.

7. The ring assembly of claim 1 wherein:

said outer ring further comprises a first set of apertures for receiving fasteners; and said inner ring further comprises a second set of apertures, wherein said first and second set of apertures are aligned for jointly receiving the fasteners.

8. The ring assembly of claim 1 wherein said inner ring is formed from a first material and said outer ring is formed from a second material that is more machinable than said first material, and wherein said outer ring comprises greater machining than said inner ring.

9. The ring assembly of claim 8 wherein material removed from said inner ring by the machining is less than material removed from said outer ring.

10. The ring assembly of claim 1 wherein said inner ring contacts said fan blade at a single surface abutment interface defined by the abutment of the load bearing surface against the aft-most end surface of said portion of said fan blade.

11. A fan blade retaining and sealing ring assembly for an aft side of a bladed disk assembly comprising:

an inner ring operable to prevent aft movement of a fan blade, said fan blade including a portion positioned in a slot formed in the blade disk; and an outer ring operable to seal against a platform of the fan blade, wherein said inner ring and said outer ring are formed from different materials;

wherein said inner ring includes a single bearing surface abutting said fan blade at a single surface abutment interface to prevent said aft movement, and wherein said single bearing surface abuts an aft-most end surface of said portion of said fan blade positioned in said slot in said blade disk to define said single surface abutment interface.

12. A method comprising the steps:

retaining a fan blade including a portion positioned in a slot formed in a blade disk to prevent aft movement with a fan blade retaining and sealing ring assembly;

sealing against a platform of the fan blade with the fan blade retaining and sealing ring assembly; and bifurcating structures of the fan blade retaining and sealing ring assembly applied for said retaining step and for said sealing step by forming the fan blade retaining and sealing ring assembly with an inner ring and an outer ring of different materials, said inner ring including a load bearing surface engaged in abutment against an aft-most end surface of said portion of said fan blade positioned in said slot in said blade disk to prevent said aft movement.

13. The method of claim 12 further comprising the steps of:

locating the inner ring on the blade disk with at least two structures defined by the inner ring.

14. The method of claim 13 wherein said locating step is further defined as:

locating the inner ring on the blade disk with an annular hook and a first set of apertures.

15. The method of claim 13 further comprising the steps of:

locating the outer ring on the blade disk with the inner ring and with a plurality of structures defined by the outer ring.

16. The method of claim 12 wherein the inner ring is formed from a first material and the outer ring is formed from a second material that is more machinable than the first material, and wherein the outer ring is subjected to greater machining than the inner ring.

17. The method of claim 16 wherein material removed from the inner ring by the machining is less than material removed from the outer ring.

18. The method of claim 12 wherein the inner ring contacts the fan blade at a single surface abutment interface defined by the abutment of the load bearing surface against the aft-most end surface of said portion of said fan blade.

19. A method comprising the steps:

retaining a fan blade including a portion positioned in a slot formed in the blade disk to prevent aft movement with a fan blade retaining and sealing ring assembly;

sealing against a platform of the fan blade with the fan blade retaining and sealing ring assembly; and bifurcating structures of the fan blade retaining and sealing ring assembly applied for said retaining step and for said sealing step by forming the fan blade retaining and sealing ring assembly with an inner ring and an outer ring of different materials, wherein the inner ring includes a single bearing surface to prevent the aft movement, and wherein the single bearing surface abuts an aft-most end surface of the portion of the fan blade positioned in the slot in the blade disk to prevent said aft movement.

20. A turbine engine comprising:

a blade disk centered on a centerline axis and defining at least one slot extending along said centerline axis;

a fan blade including a portion positioned in said at least one slot; and a retaining and sealing ring assembly positioned on an aft side of said fan blade and having an inner ring operable to prevent aft movement of said fan blade and an outer ring operable to seal against a platform of said fan blade to direct air flow into the engine core, said inner ring including a load bearing surface engaged in abutment against an aft-most end surface of said portion of said fan blade positioned in said slot in said blade disk to prevent said aft movement, wherein said inner ring and said outer ring are adjacent to one another and formed from different materials.

21. The turbine engine of claim 20 wherein said inner ring further comprises an annular hook and said blade disk further comprises an annular projection received in said annular hook, wherein cooperation between said annular hook and said annular projection locates said inner ring radially relative to said blade disk.

22. The turbine engine of claim 20 wherein said inner ring further comprises a first set of apertures and said blade disk further comprises a second set of apertures, wherein said first set of apertures and said second set of apertures are aligned to locate said inner ring circumferentially relative to said blade disk.

23. The turbine engine of claim 22 wherein said outer ring further comprises a third set of apertures, wherein said third set of apertures and said second set of apertures are aligned to locate said outer ring circumferentially relative to said blade disk.

24. The turbine engine of claim 20 wherein said outer ring further comprises an annular notch and said inner ring is further defined as being received in said annular notch, wherein cooperation between said annular notch and said inner ring locates said outer ring radially relative to said blade disk, and wherein said outer ring includes a radial inner surface adjacent said annular notch, said radial inner surface engaged in abutment against said aft-most end surface of said portion of said fan blade.

25. The turbine engine of claim 20 wherein said inner ring and said outer ring are centered on a common axis and abut one another along said axis.

26. The turbine engine of claim 20 wherein said inner ring and said outer ring overlap one another axially and radially relative to a center axis of said blade disk.

27. The turbine engine of claim 20 wherein said inner ring is formed from a first material and said outer ring is formed from a second material, wherein said second material is more machinable.

28. The turbine engine of claim 20 wherein said inner ring is formed from a first material and said outer ring is formed from a second material that is more machinable than said first material, and wherein said outer ring comprises greater machining than said inner ring.

29. The turbine engine of claim 28 wherein material removed from said inner ring by the machining is less than material removed from said outer ring.

30. The turbine engine of claim 20 wherein said inner ring contacts said fan blade at a single surface abutment interface defined by the abutment of the load bearing surface against the aft-most end surface of said portion of said fan blade.

31. The turbine engine of claim 20 wherein a radial inner surface of said outer ring contacts said aft-most end surface of said portion of said fan blade, and wherein a sealing surface of said outer ring contacts said platform, wherein said outer ring is spaced from said fan blade along at least part of a radial distance between said radial inner surface and said sealing surface.

* * * * *